United States Patent [19]

Keller

[11] Patent Number: 4,609,027

[45] Date of Patent: Sep. 2, 1986

[54] OVERHEAD DOOR

[76] Inventor: Daniel N. Keller, Rte. 4, Box 157, River Falls, Wis. 54022

[21] Appl. No.: 749,229

[22] Filed: Jun. 27, 1985

[51] Int. Cl.[4] ..... E05D 15/26

[52] U.S. Cl. ..... 160/207; 160/213; 160/193

[58] Field of Search ..... 160/207, 213, 206, 193

[56] References Cited

U.S. PATENT DOCUMENTS

| | | | |
|---|---|---|---|
| 1,843,480 | 2/1932 | Dautrick | 160/207 X |
| 2,238,181 | 4/1941 | Morgan | 160/193 |
| 2,393,052 | 1/1946 | Mehard | 160/213 X |
| 2,573,181 | 10/1951 | Burr | 160/207 |
| 3,155,147 | 11/1964 | Smith | 160/207 X |
| 3,504,729 | 4/1970 | Alton | 160/207 X |
| 4,088,172 | 5/1978 | Pollock | 160/193 |
| 4,177,854 | 12/1979 | De Vore | 160/207 |
| 4,545,418 | 10/1985 | List et al. | 160/207 X |

FOREIGN PATENT DOCUMENTS

| | | | |
|---|---|---|---|
| 147344 | 12/1950 | Australia | 160/206 |

*Primary Examiner*—Ramon S. Britts
*Assistant Examiner*—David M. Purol
*Attorney, Agent, or Firm*—Williamson, Bains, Moore & Hansen

[57] ABSTRACT

An overhead door including an upper door panel which is hingedly mounted to a horizontal header of a doorway and to a lower door panel. The door is moveable between a first, closed position wherein the door panels are vertically aligned and cooperate to close the doorway and a second, open position wherein the door panels are in a folded, generally horizontal, and parallel relation. Brace members are provided pivotally mounted to the upper door panel and adapted to engage the vertical door jambs when the door is in its second, open position to provide an angular support therebetween. The brace members are held by cables extending from the lower door panel allowing rollers located at the bottom edge of the lower door panel to engage and roll upon the vertical door jambs when the door is moved between its open position and adjacent to its closed position. In its most preferred form, the door is moveable by a winch mounted to the lower door panel, with the winch having a cable extending to a location vertically above the doorway for vertically raising and lowering the bottom edge of the lower door panel.

6 Claims, 4 Drawing Figures

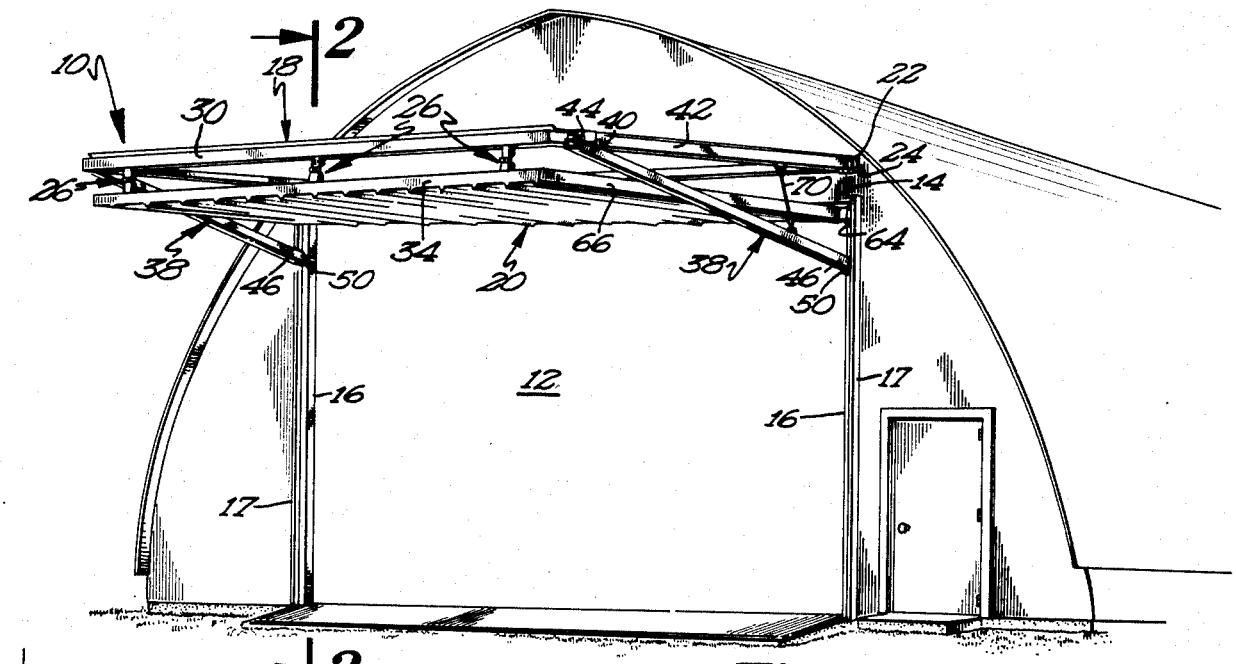
Fig 1
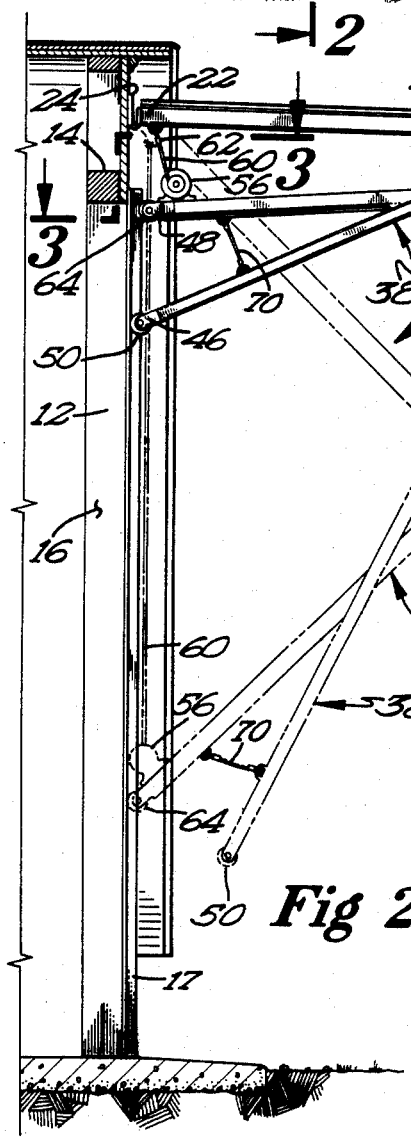
Fig 2
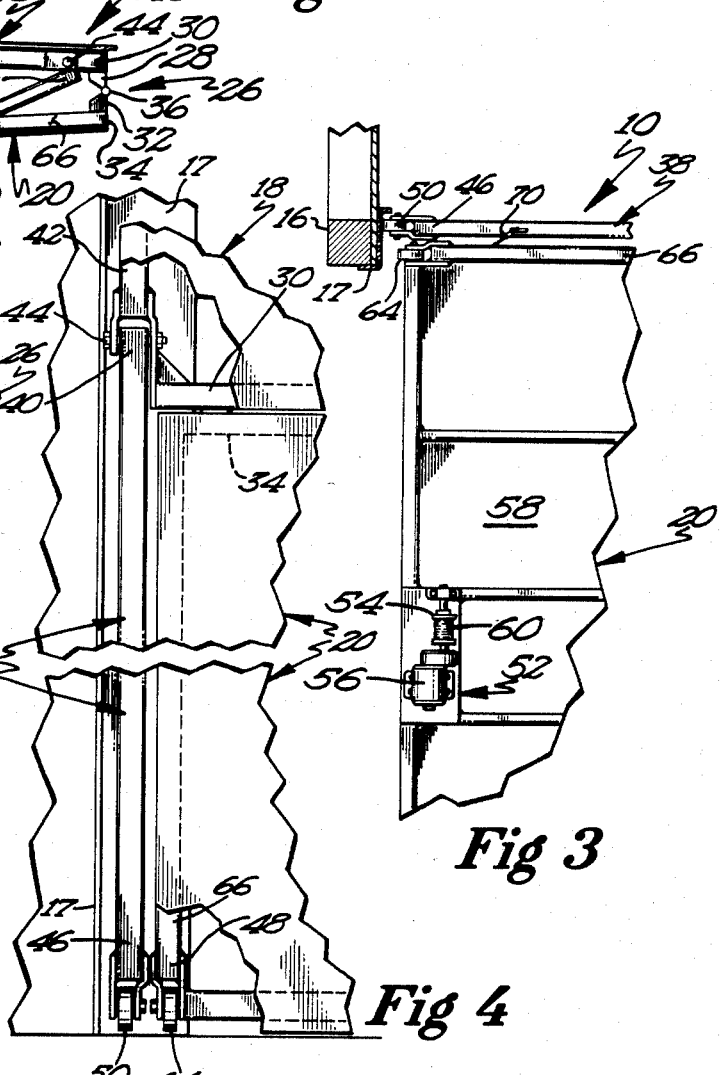
Fig 3
Fig 4

OVERHEAD DOOR

BACKGROUND OF THE INVENTION

The present invention generally relates to doors and particularly to bifold, overhead doors.

In prior overhead doors, the upper and lower door panels if held in a parallel, horizontal open position have a tendency to fall into the doorway about the hinges of the upper door panel. One method to overcome this tendency was to angle the lower door panel from the doorway to the upper door panel to form a triangular support for the door, rather than bringing the lower door panel to a horizontal position. However, this greatly increased the height of the door and/or decreased the overhead room of the door in its open position. Prior attempts to provide support for overhead doors in their open positions also included cantilever beams extending from the building, spring systems, and the like which are of complicated construction, are impractical for large overhead doors, and/or are otherwise disadvantageous. Prior art examples of such door support systems are disclosed in U.S. Pat. Nos. 2,573,181 and 3,504,729 to J. H. Burr and J. A. Alton, respectively.

Thus, a need has arisen for an overhead door including a simple support system for the door panels in their open position which overcomes the disadvantages of prior overhead doors.

BRIEF SUMMARY OF THE INVENTION

The present invention solves the aforesaid and other needs by providing an overhead door including an upper door panel hingedly mounted to a horizontal header of a doorway and to a lower door panel. The door is moveable between a first, closed position where the door panels are in a vertical, aligned condition and a second, open position where the door panels are in a generally horizontal, parallel condition. Brace members are further provided having their first ends pivotally secured to the upper door panel and having roller means on their second ends for rolling on the door jambs of the doorway. Flaccid or flexible members are provided between the lower door panel and the brace members allowing the roller means of the brace members to engage the vertical door jambs to provide an angular support between the upper door panel and the vertical door jambs when the door is located in its second, open position.

It is thus an object of the present invention to provide a novel overhead door.

It is further an object of the present invention to provide such a novel overhead door which does not restrict the overhead height of the doorway.

It is further an object of the present invention to provide such a novel overhead door which provides support for the top door panel in its upwardly open position.

It is further an object of the present invention to provide such a novel overhead door including angled brace members between the top door panel and the vertical door jambs when the top door panel is in its upwardly open position.

It is further an object of the present invention to provide such a novel overhead door which is of simple, inexpensive construction.

These and further objects and advantages of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings wherein:

FIG. 1 shows a perspective view of an overhead door constructed according to the preferred embodiment of the present invention for opening and closing a doorway in a building, with the door its fully open position.

FIG. 2 shows a cross sectional view of the overhead door of FIG. 1 according to section line 2—2 of FIG. 1 and includes a phantom view of the door in a partially open condition.

FIG. 3 shows a cross sectional view of the overhead door of FIG. 1 according to section line 3—3 of FIG. 2.

FIG. 4 is a fragmentary, front elevation view of the left side of the door in its closed condition.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top," "bottom," "upper," "lower," "first," "second," "inside," "outside," and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

An overhead door constructed according to the teachings of the preferred embodiment of the present invention is shown in the drawings and generally designated 10. Door 10 is utilized for opening and closing a doorway 12 or other desired opening in a building or the like. Generally doorway 12 includes a horizontal header 14 and first and second vertical door jambs 16 located on opposite ends of header 14.

Generally, door 10 includes an upper door panel 18 and a lower door panel 20. Upper door panel 18 is hingedly mounted about a horizontal axis adjacent its upper edge 22 to header 14 in its preferred form by hinges 24. In the preferred form, the horizontal axis of hinges 24 are located on header 14 at a spaced relation from doorway 12, and in its most preferred form, hinges 24 are located in the range of nine inches from the top of doorway 12. Lower door panel 20 is hingedly mounted by a horizontal axis to the upper door panel 18 by pivot 26. In its most preferred form, pivot 26 generally includes pivot plates 28 extending from spaced locations on the inside surface of upper door panel 18 adjacent to its bottom edge 30, pivot plates 32 extending from spaced locations on the inside surface of the lower door panel 20 adjacent to its upper edge 34, and pivot pins 36 extending through and pivotally connecting pivot plates 28 and 32.

Door 10 is generally moveable between a first, closed position where door panels 18 and 20 are vertically aligned and cooperate to close doorway 12 and a second, open position where door panels 18 and 20 are generally horizontal and parallel to each other. In its most preferred form, lower door panel 20 is narrower than upper door panel 18, but panels 18 and 20 both rest against door jambs 16 around doorway 12 of the building.

Door 10 further includes first and second brace members 38 having first ends 40 pivotally mounted to the side edges 42 of upper door panel 18 about a horizontal axis by pivot pins 44. In the most preferred form, pins 44 are located vertically spaced above bottom edge 30 of upper door panel 18. Also, in the most preferred form, brace members 38 advantageously have a length greater than the height of lower door panel 20 and specifically extend to a height generally equal to the height of pins 44 above the bottom of doorway 12 when door 10 is in its closed position as shown in FIG. 4. Thus, the second or lower ends 46 of brace members 38 are generally even with the bottom end 48 of the lower door panel 20 when door 10 is in its closed position. Brace members 38 further include rollers 50 at their second ends 46 for purposes to be explained further hereinafter.

Door 10 further includes power means 52 for moving door 10 between its open and closed positions and in its most preferred form for raising and lowering the bottom end 48 of panel 20 for moving door 10 between its open and closed positions. In its most preferred form, power means 52 comprises a winch member 54 driven by an electric motor 56 located on inside surface 58 of panel 20 adjacent to bottom edge 48. A cable 60 is wound or unwound from winch member 54 and has its free end 62 attached to panel 18 adjacent to its upper edge 22 or to a location on header 14 vertically spaced above doorway 12.

Door 10 further includes rollers 64 located on opposite side channel beams 66 of lower door panel 20 adjacent its bottom end 48. Rollers 50 and 64 of brace members 38 and panel 20 roll along the outside surface of door jambs 16, which may include suitable track members 17 to movable guide rollers 50 and 64.

Door 10, according to the teachings of the present invention, further includes flaccid members 70 shown in the most preferred form as cables extending between lower door panel 20 and brace members 38 adjacent the bottom edge of panel 20 and ends 46 of brace members 38.

The basic construction of door 10 according to the preferred teachings of the present invention having been set forth, the operation of door 10 will now be described. In operation, in its closed position, brace members 38 abut vertically with door jambs 16 of door 12. When raising means 52 is activated thereby winding cable 60 on winch 54, bottom end 48 of panel 20 is vertically drawn upward by cable 60. Due to pivot 26 and hinges 24, door panels 18 and 20 begin to fold. As door 10 is thus raised upwardly, rollers 64 of panel 20 roll along door jambs 16, and particularly along tracks 17 in the preferred embodiment. Door panels 18 and 20 are thus supported by hinges 24, pivot 26, and rollers 64. Brace members 38 do not initially provide support to door 10, and as is shown in phantom lines in FIG. 2, rollers 50 on braces 38 do not engage door jambs 16 when door 10 is partially raised. As bottom end 48 of panel 20 is continued to be drawn upwardly, cables 70 become tight such that brace members 38 are raised with door panel 20. When door panel 20 is located adjacent to its open position, rollers 50 of brace members 38 engage with door jambs 16 and tracks 17 thereon. As door 10 continues to move to its open position, brace members 38 support the bottom edge 30 of top door panel 18 to keep door panels 18 and 20 from tipping into doorway 12. When door 10 is in its open position, rollers 64 of door panel 20 do not have to engage the door jambs 16.

When door 10 is moved from its open position to its closed position, cable 60 is unwound from winch 54 lowering bottom edge 48 of panel 20. Rollers 50 of brace members 38 then roll down the door jambs 16 until rollers 64 engage with door jambs 16 and support door 10. At that time, cables 70 hold brace members 38 adjacent to door panel 20 until door 10 is adjacent its closed position. In its fully closed position, brace members 38 abut against door jambs 16 and lie against the building face. The narrower width of lower door panel 20 with respect to upper door panel 18 permits brace members 38 to be pivotally supported outside of side channel beams 66 of lower door panel 20 closely adjacent thereto and still lie against and be guided within tracks 17. Since brace members 38 have a length greater than the height of lower door panel 20, they are able to engage door jambs 16 at an acute angle thereto as shown in FIG. 2 to properly support the outer or lower end 30 of upper door panel 18 with door 10 in its open position.

It can thus be appreciated that brace members 38 provide an angular support between the bottom edge 30 of upper door panel 18 and the door jambs 16 to prevent the door panels 18 and 20 from pivoting downwardly as a unit about hinges 24 into doorway 12 when door 10 is raised to the fully open position of FIG. 2. Specifically, prior to the present invention, the bottom door panel was not typically moved into a parallel relation with the top door panel but angled downwardly and inwardly towards the building frame with a typical vertical header space of about two feet to serve as a support mechanism for the top panel. Thus, the overhead room with the door in its open position was decreased and/or the total height of the door was increased to compensate for this triangular positioning of the door panels. Thus, utilizing brace members 38 according to the teachings of the present invention allows the door panels 18 and 20 to be positioned horizontally to each other while providing the support necessary to prevent the folded door from tipping into the doorway. In its preferred form, the vertical header space for door 10 according to the present invention is generally equal to the distance of hinges 24 from the top of doorway 12 and in the preferred embodiment is generally in the range of nine inches. Due to the horizontal positioning of door panels 18 and 20, the overhead space at doorway 12 is increased while minimizing door panel size according to the teachings of the present invention.

It should be further appreciated that lower door panel 20 is very securely held in the open position by cable 60 extending between the bottom end 48 of panel 20 and upper edge 22 of panel 18, and by its connection at pivot 26 to upper door panel 18.

Additionally, pivot plates 28 and 32, which position pivot pins 36 inwardly from edges 30 and 34 of door panels 18 and 20, allow door panels 18 and 20 to be horizontal in the open position of door 10. Specifically, if the pivotal connection between the door panels was located adjacent to their abutting edges, it would be necessary for the door panels to abut with each in order to be parallel to each other, a physical impossibility for many hinges. Furthermore, if the door panels are not in a horizontal position, the lower door panel then is angled downwardly and inwardly into the doorway, decreasing overhead room and resulting in other disadvantages as set forth hereinbefore.

It should be appreciated that the mounting of power means 52 adjacent to lower edge 48 of door panel 20 is advantageous over other mounting positions. Specifically, motor 56 and winch member 54 can be easily mounted to door panel 20 when door 10 is in its closed position without requiring the heavy lifting and positioning required when the motor and winch are mounted above the doorway 12. Furthermore, the weight of motor 56 and winch member 54 on door 10 acts as an anchor in providing dead weight thereto when door 10 is in its closed position to provide stability to door 10.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An overhead door for a doorway, with the doorway having a horizontal header and first and second vertical door jambs located on opposite ends of the horizontal header, comprising, in combination:

an upper door panel having a first side, a second side, an upper edge, and a lower edge;

first hinge means for hinging the upper edge of the upper door panel to the horizontal header about a horizontal axis;

a lower door panel having a first side, a second side, an upper edge, and a lower edge;

second hinge means located adjacent the upper edge of the lower door panel and the lower edge of the upper door panel for hinging the lower door panel to the upper door panel about a horizontal axis, with the upper and lower door panels cooperating to close the doorway, with the lower door panel having a predetermined height in the vertical, closed position of the door;

first and second elongated brace members having first and second ends, with the first ends of the brace members being pivotally mounted on the first and second sides of the upper door panel about a horizontal axis, and with the length of the first and second brace members being greater than the height of the lower door panel;

roller means located on the second ends of the brace members for rolling on the vertical door jambs of the door opening;

roller means located on the sides of the lower door panel adjacent its lower edge for rolling on the vertical door jambs of the door opening;

power means for moving the upper and lower door panels between a first closed position wherein the upper and lower door panels are in a vertical, aligned condition and a second open position where the upper and lower door panels are in a generally horizontal position and generally parallel to each other; and first and second flaccid means secured between the lower door panel and the first and second brace members for allowing the roller means of the lower door panel to engage with the vertical door jambs of the door opening when the door panels are between their first, closed position and adjacent their second, open position, whereby the roller means of the brace members engage with the vertical door jambs of the door opening when the door panels are in their second, open position and the brace members thereby provide an angular support between the lower edge of the upper door panel and the vertical door jambs of the door opening.

2. The overhead door of claim 1 wherein the means for moving the upper and lower door panels between their first closed position and their second open position comprises power means for raising and lowering the lower edge of the lower door panel.

3. The overhead door of claim 2 wherein the raising and lowering power means comprises, in combination:

a winch mounted on said lower door panel adjacent the lower edge thereof;

a motor drivingly connected to said winch; and a cable having a first free end anchored at a location vertically spaced above the doorway and a second end wound on said winch.

4. The overhead door of claim 1 wherein the upper and lower door panels have inside surfaces; and wherein the second hinge means comprises, in combination: first pivot plates extending generally perpendicularly from the inside surface of the upper door panel adjacent to its bottom edge and having free ends; second pivot plates extending generally perpendicularly from the inside surface of the lower door panel adjacent to its upper edge and having free ends; and pivot pins extending through the free ends of the first and second pivot plates and defining the horizontal axis of the second hinge means, with the horizontal axis of the second hinge means being spaced from the upper edge of the lower door panel and the lower edge of the upper door panel for vertically spacing the lower and upper door panels when the door panels are in their second open position, thereby insuring that the lower and upper door panels may be substantially parallel to each other in their second open position.

5. The overhead door of claim 1 wherein the flaccid means comprises cables extending between the lower door panel and the brace members.

6. The overhead door of claim 1 wherein said lower door panel is of a width less than that of said upper door panel and said brace members are pivotally supported from the side edges of said upper door panel outside of the side extremities of said lower door panel closely adjacent thereto with both said brace member roller means and said lower door panel roller means tracking on said vertical door jambs.

* * * * *